United States Patent [19]

Graf et al.

[11] 3,988,554

[45] Oct. 26, 1976

[54] GAS-BLAST SWITCH

[75] Inventors: Rudolf Graf, Oberentfelden; Hans Heutschi, Kappel near Olten; Ernst Lang, Schlossrued; Viktor Stephanides, Zurich; Richard Thaler, Unterentfelden; Hans-Rudolf Wüthrich, Oberentfelden, all of Switzerland

[73] Assignee: Sprecher & Schuh AG, Aarau, Switzerland

[22] Filed: July 7, 1975

[21] Appl. No.: 593,869

[30] Foreign Application Priority Data

July 29, 1974 Switzerland ..... 10363/74

[52] U.S. Cl. ..... 200/148 A; 200/150 G

[51] Int. Cl.[2] ..... H01H 33/88

[58] Field of Search ..... 200/148 A, 150 G

[56] References Cited

UNITED STATES PATENTS

| | | | |
|---|---|---|---|
| 3,940,583 | 2/1976 | Hertz | 200/148 A |
| 3,941,962 | 3/1976 | Thaler | 200/148 A |

*Primary Examiner*—Robert S. Macon

*Attorney, Agent, or Firm*—Werner W. Kleeman

[57] ABSTRACT

A gas-blast switch possessing a fixed contact and a movable contact and a blast or discharge nozzle surrounding one of the contacts, the blast nozzle having its inlet connected with the outlet of a pump compartment for an extinguishing gas, this pump compartment can be pressurized by the switch cut-off or switching-off movement, and wherein the narrowest location or throat of the blast nozzle is arranged in the direction of blowing downstream with respect to the aforementioned one contact. The outlet of the pump compartment can be closed by a check or nonreturn valve which closes in the direction of the pump compartment. The inlet of the blast nozzle is connected via a gas chamber with the outlet of the pump compartment, the outlet of the gas chamber confronting the blast nozzle can be closed by means of a further check or nonreturn valve which closes in the direction of the gas chamber. In the inlet of the gas chamber which confronts the pump compartment there opens a throughpassage emanating from the inlet of the blast nozzle, this throughpassage possessing a third check or nonreturn valve which opens in the direction towards the aforementioned inlet of the gas chamber.

6 Claims, 5 Drawing Figures

GAS-BLAST SWITCH

BACKGROUND OF THE INVENTION

The present invention relates to a new and improved construction of a gas-blast switch of the type comprising a fixed contact and a movable contact and a blast or discharge nozzle surrounding one such contact, the inlet of the blast nozzle being connected at the outlet of a pump compartment for an extinguishing gas, this pump compartment can be placed under pressure or pressurized by the switch cut-off or switching-off movement, and further, wherein the narrowest location or throat of the blast nozzle is arranged downstream of the blowing direction of the extinguishing gas with respect to the aforesaid one contact, and the outlet of the pump compartment can be closed by means of a check or nonreturn valve which closes in the direction of the pump compartment.

During the course of switching-off such type switch there prevails, as is well known, an arc. The intensity of this arc is dependent upon the momentary value of the current. Owing to its high temperature the arc, as a function of its intensity, heats-up the extinguishing or quenching gas delivered thereto from the pump compartment and which gas blows against the arc. Consequently, there prevails a pressure surge which counteracts the blowing pressure emanating from the pump compartment and forces back the extinguishing gas expelled therefrom. This counter pressure causes the check valve which is associated with the outlet of the pump compartment to close such outlet. As a result, there is prevented the penetration of the arc gases into the pump compartment, and which arc gases at that moment in time are still hot and as a general rule ionized and contaminated with metallic vapors. This enables at the same time reducing the power requirements for the switch drive, because such of course not only is responsible for the switching-off or cut-off movement of the movable contact, rather also must bring about the compression of the extinguishing or quenching gas in the pump compartment.

While with this arrangement there is present the advantage which is derived from the provision of the check valve operatively associated with the outlet of the pump compartment, there is also, however, present the disadvantage that the arc as a practical matter no longer can be blown for such length of time as the pressure of the arc gases exceed the pressure prevailing in the pump compartment —it being mentioned that the pressure of the arc gases does however decrease with the decreasing current and the pressure in the pump compartment increases as the switching-off or cut-off movement progresses— i.e. as long as the check valve is closed.

In other words, with the state-of-the-art switches of the previously mentioned type there cannot be achieved, or at least not to a sufficient degree, a blowing of the arc just at that time span when the blowing action would be most effective in consideration of the subsequent null-crossover of the current. In any event, the heretofore known prior art switches of the previously mentioned type do not even approximately permit of a current-dependent blowing of the arc.

SUMMARY OF THE INVENTION

Hence, with the foregoing in mind, it is a primary object of the present invention to provide a new and improved construction of gas-blast switch which is not associated with the aforementioned drawbacks and limitations of the prior art proposals.

Another object of this invention aims at a novel construction of gas-blast switch of the previously mentioned type which extensively eliminates the aforementioned drawbacks.

Still a further significant object of the present invention aims at constructing a switch of the previously mentioned type in such a manner that the pressure surge resulting due to the arc gases can be beneficially employed for augmenting the blowing or the arc.

Now in order to implement these, and still further objects which will become more readily apparent as the description proceeds, the gas-blast switch of this development is manifested by the features that the inlet of the blast nozzle is connected via a gas chamber with the outlet of the pump compartment, the outlet of the gas chamber which confronts the blast nozzle can be closed by a further check valve which closes in the direction of the gas chamber, and in the inlet of the gas chamber confronting the pump compartment there opens a throughpassage emanating from the inlet of the blast nozzle, this throughpassage being provided with a third check or nonreturn valve which opens in the direction of the aforementioned gas chamber-inlet.

With the proposed gas-blast switch of this development the gas chamber forms a type of pressure storage which is either supplied by the pump compartment or, however, by the inlet of the blast nozzle depending upon the pressure conditions and which pressure storage, in turn, supplies the inlet of the blast nozzle.

It is advantageous if the gas chamber is arranged in a ring-shaped or annular configuration at an extension of the blast nozzle at the inlet side thereof. It is equally advantageous if the third check or nonreturn valve is arranged at the mouth or opening of the throughpassage into the inlet of the gas chamber. A particularly advantageous and beneficial construction resides in the features that the ring-shaped or annular-shaped gas chamber is bounded or limited at its internal side by a tubular-shaped intermediate component or portion which encloses in radial spaced relationship the aforementioned one contact, the intermediate compartment or space to such contact forming the throughpassage.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENT

Figure 1:
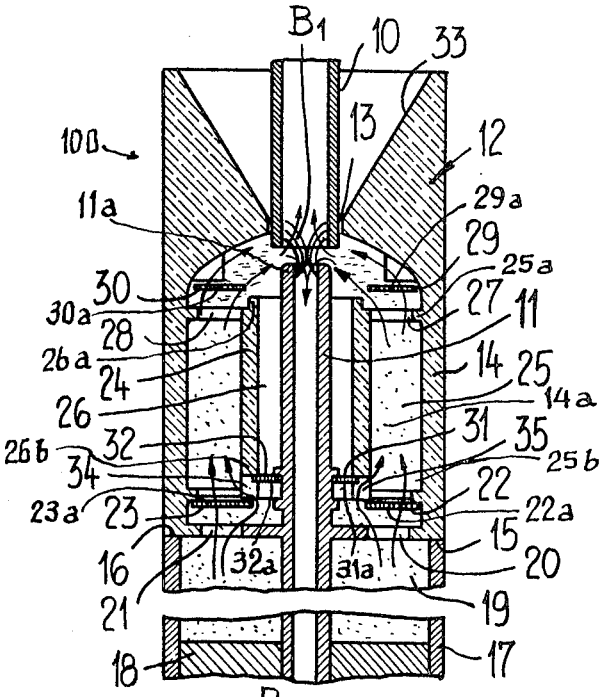
FIG. 1 is a schematic axial sectional view through a gas-blast switch portraying the essential components thereof as concerns the development of this invention, the gas-blast switch being shown in a starting phase of the switching-off or cut-off operation.

Describing now the drawing, it is to be appreciated that the preferred exemplary embodiment of gas-blast switch shown in FIGS. 1 to 5 illustrates throughout the aforementioned various Figures the same components, so that these components will be described for the most part simply in conjunction with FIG. 1 and on the basis of the reference characters employed therewith, whereas on the basis of the remaining FIGS. 2 to 5 there will be essentially only described the course of the cut-off operation of the switch, these Figures showing different phases of the cut-off operation at successive time intervals.

Hence, by referring specifically to FIG. 1 there will be recognized a stationary, substantially tubular-shaped contact 10 and a likewise substantially tubular-shaped, movable contact 11 of a gas-blast switch, generally indicated by reference character 100. In the switch-on position (not illustrated) the movable contact 11 engages with the interior of the contact 10. The movable contact 11 is surrounded by a blast or discharge nozzle 12 which is movable along with the movable contact 11. The narrowest location or throat 13 of the blast nozzle 12 —viewed in the blowing direction of the extinguishing gas— is arranged downstream with respect to the free end 11*a* of the movable contact 11. At the inlet side of such blast nozzle 12 the latter possesses a substantially tubular-shaped extension or elongated portion 14, the free end edge 15 of which is attached to the upper end or end face 16 of a pump cylinder 17. Within the pump cylinder 17 there is displaceably mounted a stationarily supported pump piston 18, so that the pump compartment 19 which is defined or bounded by the pump cylinder 17 and the pump piston 18, during the course of the switching-off or cut-off movement, i.e. the downward movement of the components 11 and 12, experiences a reduction in size or volume and there is thus undertaken a compression of the extinguishing gas contained in such pump compartment 19.

Adequately dimensioned throughpassage openings 20, 21 lead from the pump compartment 19 into the interior of the tubular-shaped extension 14 merging at the inlet side at the blast or discharge nozzle 12. The flow of extinguishing gas through these openings 20, 21 is controlled by check valves 22*a*, 23*a* which close in the direction of the pump compartment 19. The closure portions or components 22, 23 of these check valves 22*a*, 23*a* have been shown in open position in FIG. 1, so that in the presence of a sufficient overpressure in the pump compartment 19 there can occur a free flow of the extinguishing gas into the blast nozzle 12, and which extinguishing gas has been precompressed in the pump compartment 19. The internal space or compartment 14*a* of the tubular or pipe-shaped extension 14 is subdivided into two shell or jacket compartments or chambers 25, 26 by a substantially tubular-shaped intermediate body 24. The outlet 25*a* of the jacket or shell compartment 25, which defines a gas chamber, in the direction of the blast nozzle 12 also possesses adequately dimensioned outlet or discharge openings 27, 28, which, similar to the throughpassage or throughflow openings 20, 21, are controlled by check or nonreturn valves 29*a*, 30*a* which close in the direction of the jacket compartment or gas chamber 25. In FIG. 1 the closure portions or components 29, 30 of these check valves 29*a*, 30*a* have been illustrated in their open position. The jacket or shell compartment 26, defining a throughpassage means, has an end 26*a* confronting the throat 13 of the blast nozzle 12 which is open. On the other hand, the end 26*b* of the jacket or shell compartment 26 confronting the pump compartment 19 is controlled by a further check or nonreturn valve arrangement 31, 32 which is open when there prevails an excess or overpressure in the jacket compartment 26. The check valves, particularly the valves 29*a*, 30*a*, 31, 32 may be constructed as plate valves or the like by way of example. Moreover, the volume of the gas chamber 25 may be advantageously greater than the volume of the compartment or throughpassage means 26.

In FIG. 1 the check valve arrangement or check valves 31, 32 have been illustrated in the closed position. With the check valves 31, 32 in the open position, the end 26*b* of the jacket or shell compartment 26 which appears at the lower portion of FIG. 1 is connected through the agency of lateral throughpassages or bores 34, 35 with the end 25*b* of the jacket compartment or gas chamber 25 likewise appearing at the lower portion of FIG. 1. It should be understood that the closure portions or components 22, 23 of the check valves 22*a*, 23*a*, the closure portions 29, 30 of the check valves 29*a*, 30*a* and the closure portions 31*a*, 32*a* of the check valve arrangement 31, 32 are prebiased in the closing direction by means of not particularly illustrated resilient or spring elements or equivalent structure. From what has been discussed above it will be further recognized that the blast or discharge nozzle 12 basically is only supplied via the gas chamber 25 with compressed extinguishing or quenching gas arriving from the pump compartment 19.

The mode of operation of the exemplary illustrated embodiment of gas-blast switch can be summarized as follows: It is assumed that at the point in time $t=0$ the switching-off or cut-off movement has begun, i.e. the movement of the movable contact 11 away from the stationary contact 10. This is illustrated by means of the coordinate-origin of the current-time graph associated with each Figure at the bottom region of each such associated Figure. At the start of the switching-off movement the pump compartment 19 is placed under pressure by the stationary pump piston 18. The extinguishing or quenching gas first however can come into play when there is provided an outlet or discharge for such gas, that is to say, then when the movable contact 11 has been positioned so that it is no longer in engagement with the stationary contact 10. This position has been illustrated in FIG. 1 and designated by reference character $P_1$ in the current-time graph thereof. Between the contacts 10, 11 which are now in spaced relationship from one another there burns an arc $B_1$. Since this arc only possesses a relatively small length, it is not yet capable of generating a large pressure surge, so that due to the overpressure or excess pressure in the pump compartment 19 the valve closure portions 22, 23 as well as 29 and 30 are forced into the open position, and as indicated by the arrows, the arc $B_1$ is blown and the extinguishing gas can escape through the interior of the contacts 10, 11. The condition illustrated in FIG. 1 consequently only lasts for a few milliseconds (ms). Although the initial maximum value of the current has already been exceeded, the intensity of the arc increases with increasing spacing of the contacts 10, 11 from one another, so that there is developed by the arc gases an excess or overpressure at the region of the throat 13 of the blast or discharge nozzle 12. These arc gases have been schematically indicated in the Figures by the dashed grid-like lines, whereas the fresh extinguishing has been indicated by the point-like grid lines.

Figure 2:
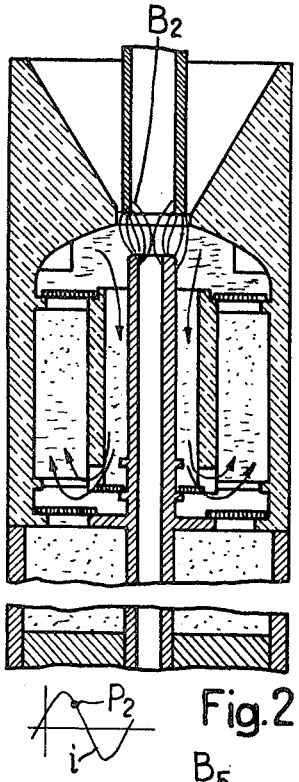
FIGS. 2, 3, 4 and 5 are respective axial sectional views, comparable to the showing of FIG. 1 of the arrangement of gas-blast switch depicted therein, and portraying different phases of the switching-off operation at successive time intervals.
Figure 3:
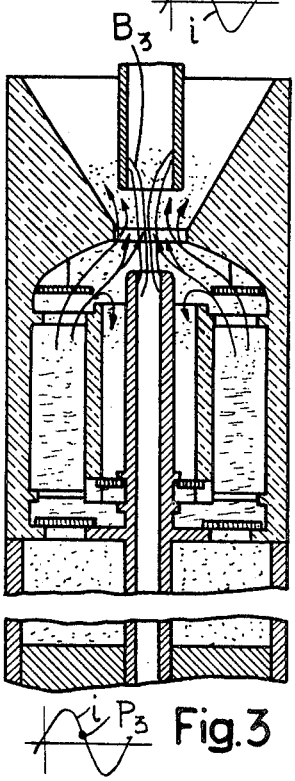
Figure 4:
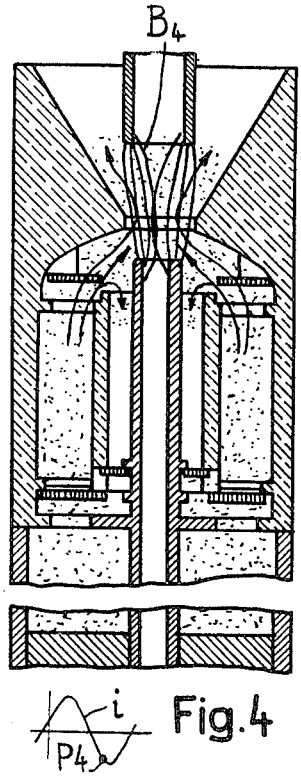
Figure 5:
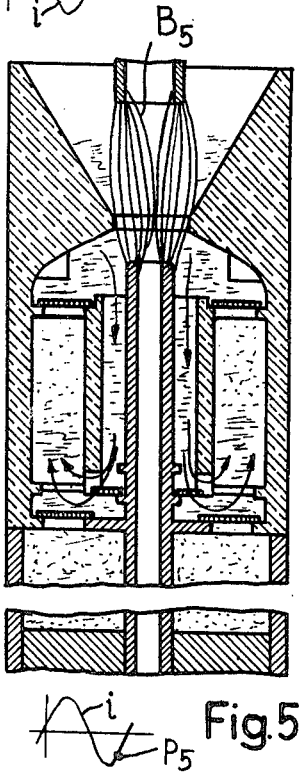

As illustrated in FIG. 2 these arc gases force the valve closure components 29, 30 into the closed position, so that the arc gases cannot penetrate through the openings 27, 28 into the jacket or shell compartment or gas chamber 25. On the other hand, the arc gases flow back into the jacket or shell compartment 26, open the check valves 31, 32, force the valve closure components 22, 23 into the closed position and flow from below into the gas chamber or jacket 25, where the still present, fresh extinguishing gas in further compressed from below by means of a gas cushion formed of the arc gases. Also this operational phase lasts for only a few milliseconds (ms) since the arc $B_2$ is of decreasing intensity due to the rapidly decreasing momentary value of the current. At the region of the null-crossover (FIG. 3) the pressure of the arc gases also decreases, so that the check valves 31, 32 again close. However, there remains in the gas chamber or jacket compartment 25 the pressure cushion delievered by the arc gases, which leads to the result that the valve closure components 29 and 30 again open and the extinguishing gas located in the gas chamber again blows the arc $B_3$ which at the region of the null-crossover has lost a considerable amount of its intensity. During the expansion of the arc gases in the gas chamber 25 such rapidly cool-off and thus also lose their conductivity. The pressure in the pump compartment 19 which has further built-up in the meantime, thus forces the valve closure components 22, 23 again into their open position, so that fresh extinguishing gas can reflow into the gas chamber or jacket compartment 25, at that location brings about a further cooling and furthermore forcefully blows the arc $B_4$ (FIG. 4). The position of the check valves during the operating phase illustrated in FIG. 4 is the same as in FIG. 1. The difference resides in the flow of the extinguishing gas, which in the showing of FIG. 4 now no longer can exclusively escape through the interior of the contacts 10, 11, rather primarily through the diffuser 33 (FIG. 1) of the blast nozzle 12. This possibility of escape is also offered to the arc gases. Moreover, the arc gases at the time span of the second peak value of the current can attain a pressure which exceeds the pressure arising from the pump compartment 19 and thus can force the valve closure components 29, 30 and 22, 23 into the closed position and the check valves 31 and 32 into the open position. Hence, as shown in FIG. 5, there again appears at the inlet of the gas chamber 25 a pressure cushion built-up from the arc gases which, as soon as the pressure at the region of the throat 13 of the blast nozzle 12 again drops, forces the valve closure components 29 and 30 again into the open position and the check valves 31 and 32 into the closed position, with a result that the arc is again forcefully blown.

With the described gas-blast switch there is thus not only effectively prevented the penetration of arc gases into the pump compartment 19, rather the pressure peaks or spikes thereof are utilized in order or again initiate considerably earlier the blowing of the arc than if such were to occur only by virtue of the extinguishing gas delivered by the pump compartment 19. Equally, it should be readily apparent that as a result there is realized a saving in the drive power required for the switch.

Additionally, the check or nonreturn valves need not be dimensioned to be particularly robust, since the pressure of the arc gases to a certain extent in deflected against itself.

While there is shown and described present preferred embodiments of the invention, it is to be distinctly understood that the invention is not limited thereto, but may be otherwise variously embodied and practiced within the scope of the following claims. Accordingly, What is claimed is:

1. A gas-blast switch comprising a fixed contact, a movable contact, a blast nozzle surrounding one of the contacts, means defining a pump compartment for an extinguishing gas, said pump compartment having an outlet, said blast nozzle having a throat portion and an inlet, the inlet of the blast nozzle being connected with the outlet of the pump compartment, said pump compartment can be pressurized by the switching-off movement of the gas-blast switch, said throat portion of the blast nozzle being arranged, with respect to the direction of blowing of the extinguishing gas, downstream with regard to said one contact, check valve means for closing the outlet of the pump compartment, said check valve means closing in the direction of the pump compartment, means defining a gas chamber having inlet means and outlet means, the inlet of the blast nozzle being connected by means of the gas chamber with the outlet of the pump compartment, the outlet means of the gas chamber confronting the blast nozzle, a second check valve means for closing the outlet means of the gas chamber confronting the blast nozzle, said second check valve means closing in the direction of the gas chamber, the inlet means of the gas chamber confronting the pump compartment, throughpassage means emanating from the inlet of the blast nozzle and opening into the inlet means of the gas chamber, a third check valve means provided for said throughpassage means, said third check valve means opening in the direction of the inlet means of the gas chamber.

2. The gas-blast switch as defined in claim 1, wherein said gas chamber is arranged in a ring-shaped configuration at an extension of the blast nozzle, said extension being located at an inlet side of said blast nozzle.

3. The gas-blast switch as defined in claim 1, wherein the third check valve means is arranged at the location of opening of the throughpassage means into the inlet means of the gas chamber.

4. The gas-blast switch as defined in claim 2, wherein the ring-shaped configured gas chamber is limited at its inside by a substantially tubular-shaped intermediate component surrounding said one contact in radial spaced relationship therefrom to define therebetween an intermediate space, said intermediate space forming said throughpassage means.

5. The gas-blast switch as defined in claim 1, wherein said second check valve means and said third check valve means comprise plate valves.

6. The gas-blast switch as defined in claim 1, wherein the volume of the gas chamber is greater than the volume of the throughpassage means.

* * * * *